United States Patent [19]

Bechtiger et al.

[11] 4,269,050

[45] May 26, 1981

[54] TIME LOCK WITH KICKER ARM CARRIER ACTUATOR

[75] Inventors: Charles G. Bechtiger, La Chaux-de-Fonds, Switzerland; James C. Miller, Nicholasville, Ky.

[73] Assignee: Sargent & Greenleaf, Inc., Nicholasville, Ky.

[21] Appl. No.: 940,834

[22] Filed: Sep. 7, 1978

[51] Int. Cl.[3] ..... E05B 43/00

[52] U.S. Cl. ..... 70/272; 70/267; 368/62

[58] Field of Search ..... 70/272–274, 70/267–271; 58/21.13, 21.14, 126 E; 200/39 R

[56] References Cited

U.S. PATENT DOCUMENTS 588,627 8/1897 Blake ..... 70/273

638,892 12/1899 Taylor ..... 70/272

4,062,210 12/1977 Uyeda ..... 70/268

*Primary Examiner*—William E. Lyddane

*Attorney, Agent, or Firm*—Mason, Fenwick & Lawrence

[57] ABSTRACT

The invention disclosed in the application is a time lock for bank vault doors and the like having a plurality of timer units of the settable dial type with a clockwork mechanism which includes a slip clutch in the gear train which permits the main winding stem to be rotated in an unwinding direction to move the dial in a descending time direction if it has been overdriven to a higher time setting than desired, and which includes a kicker arm mechanism to be abruptly kicked by spring force against a carrier assembly for the time lock unit to shift the carrier to release position when the dial reaches zero time.

24 Claims, 11 Drawing Figures

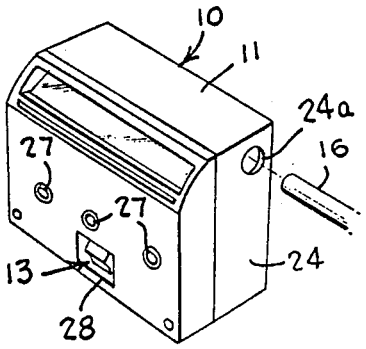
FIG-1
FIG-3
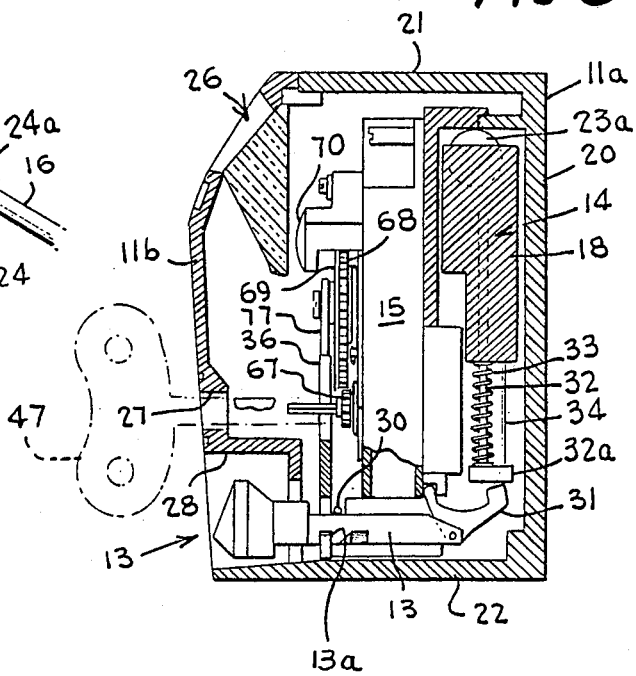
FIG-2
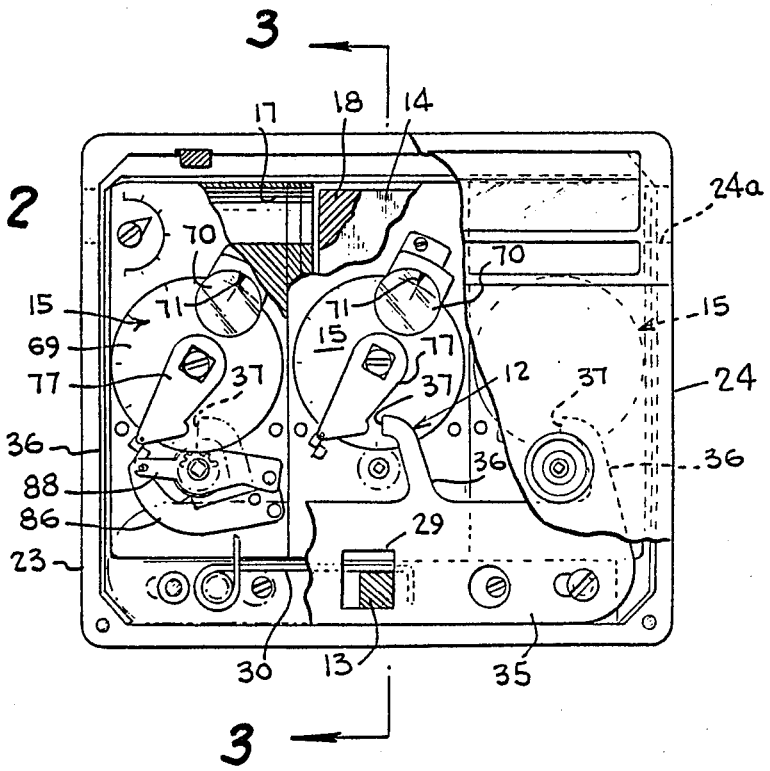

TIME LOCK WITH KICKER ARM CARRIER ACTUATOR

BACKGROUND AND OBJECTS OF THE INVENTION

The present invention relates in general to time locks for bank vaults and safes and similar timed high security devices for security receptacles, and more particularly to the specific structure of manually settable timer units or clockwork movements used in bank vault time locks to set the locking hours for the vault or safe door or the time the safe or vault is desired to be capable of being opened the following day to maintain the vault or safe securely locked during certain predetermined lock-out hours such as the period between daily bank closing and subsequent day opening.

Heretofore, time locks have been in common, widespread use to place bank vaults and similar safes, security spaces, and the like in a lock-out condition rendering them disabled from being opened in the normal way by bank personnel, as by proper dialing of a combination lock, during certain chosen times, such as between the bank closing time one day and its opening time the next day. In recent years, these time locks have customarily involved a box or case having two or three timer units or clockwork movements, to provide back-up redundancy in case one or two of the timer units fail, each of which has a settable dial graduated in hours and set from a key insertable into openings in the time lock case to indicate the desired locking hours or time lapse between setting of the timer and the time of opening of the vault the next working day. Each timer unit or movement customarily has a main spring and gear system to concurrently wind the main drive spring for the clockwork mechanism and drive the dial in a wind-up or increasing time lapse direction relative to a stationary pointer or index mark, and the dial usually has a trip pin or stub fixed on the dial face to engage an abutment surface on the end of a rigid arm extending from a transversely movable carrier when the associated timer unit dial times out to zero time and move the carrier to a release position allowing a snubber bar connected in the usual manner to the bolts for the vault door, as by connection to a common control bar for the bolts, to retract to unlocking position. The carrier typically has three of such rigid arms extending to abutment ends located at the zero time positions for the trip pins of each of the three dials of the three timer units, so that any one of the three trip pins when it engages the abutment end surface of the associated extension arm of the carrier will push the carrier toward its release position by the force of the stored energy in the associated main drive spring to unlock the time lock.

It will be appreciated that reliance on the force exerted by such a rigid dial trip pin on the abutment end of the extension arm of the time lock carrier as the trip pin is driven by its associated main drive spring to and below the zero time position introduces small variations in the exact time at which the time lock is released to unlocked position. Slight variations in dimensions due to wear during use, manufacturing tolerances and the like can produce differences of up to ten minutes or more in the exact time the carrier is shifted fully to release or unlocked position when the unlocking or release movement of the carrier is dependent on its being pushed by the dial trip pin of the timer unit driven by the main drive spring of the timer unit. While this has been a recognized problem with such time locks for many years, the trip pin fixed on the timer unit dial continues to be the dominant mechanical system for moving the carrier to unlocking position and I am aware of no modification to more positively and immediately force the carrier to unlocking position responsive to the dial reaching zero time.

An object of the present invention is the provision of a novel timer unit of the settable dial type for time locks wherein a snap-action kicker or activator arm is provided on the dial mechanism which is cocked and latched during setting of the dial and is released to abruptly kick the carrier of the time lock to unlocked position when the dial times down to zero time.

Another object of the present invention is the provision of a timer unit for time locks as described in the immediately preceding paragraph, wherein the snap-action kicker arm is journaled on the center spindle for the dial and is associated with a spring system and a cam and latch lever mechanism to maintain the kicker arm in a cocked position until the dial times down to zero time and thereupon releases the arm to be kicked against the carrier by a spring through a trip stroke and move the carrier to unlocking position.

Another long standing problem with time lock timer units as conventionally made is that the gearing system from the main spring and setting key spindle which is coupled to the timing gear train and to the dial, by which the dial is set to the desired time delay setting, permits operation of the key only in the wind-up or increasing-time direction. Thus if the operator inadvertently advances the dial setting in a wind-up direction to a time above or longer than the time lapse setting desired (as where a 12 hour delay setting is desired and the dial is overset to 14 or 15 hours) the conventional timer unit does not have the capability of allowing the operator to manually turn the key in a wind-down direction to reduce the setting and the only way for the dial to be moved down to the proper time setting is for it to time-down by the main drive spring and clockwork gearing.

Another object of the present invention therefore is the provision of a novel timer unit for time locks wherein the time delay setting gearing includes means permitting the setting key to be operated in a wind-down or reducing time lapse direction as well as in an increasing time lapse direction to permit the operator to reduce the dial time setting when desired to correct for incorrect settings of the dial to excess or too-high time delay settings.

Other objects, advantages and capabilities of the present invention will become apparent from the following detailed description, taken in conjunction with the accompanying drawings showing a preferred embodiment of the invention.

BRIEF DESCRIPTION OF THE FIGURES

FIG. 1 is a front perspective view of a time lock for safes, vaults and similar enclosures embodying the present invention;

FIG. 2 is a front elevation view thereof with parts of the front cover and the carrier member broken away;

FIG. 3 is a vertical transverse section view thereof taken along the line 3—3 of FIG. 2;

DETAILED DESCRIPTION OF A PREFERRED EMBODIMENT

Figure 5:
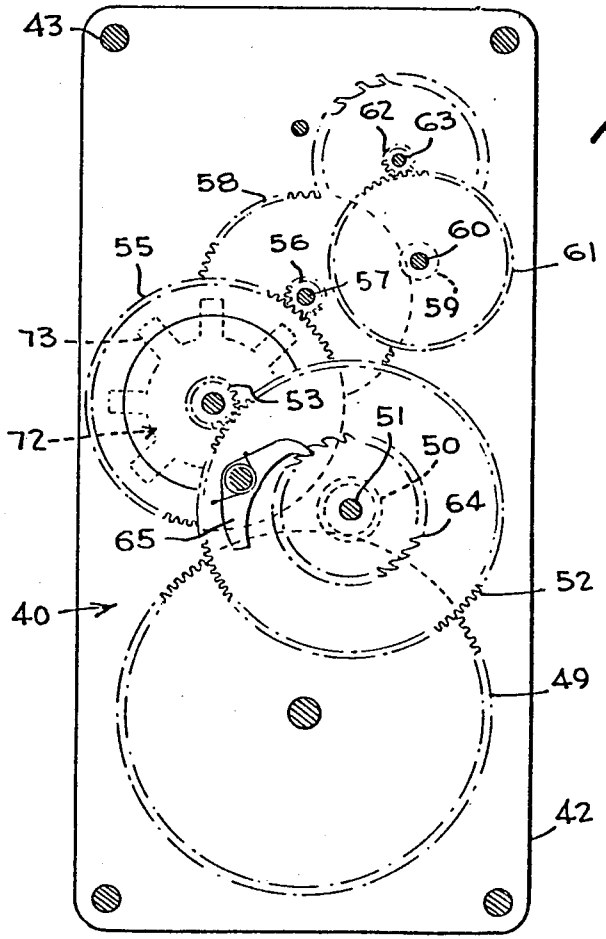
FIG. 5 is a vertical section view taken along the line 5—5 of FIG. 4 showing the clockwork gearing associated with the escapement wheel forming a gear train between the main spring and the escapement.

Referring to the drawings, wherein like reference characters designate corresponding parts throughout the several figures, there is shown a typical time lock, generally indicated by the reference character 10, having a case or housing 11 of generally rectangular box-like form for housing the components of the time lock including the usual carrier assembly 12 for normally latching a push lever 13 in a locking position holding a snubber bar blocking mechanism 14 in a blocking position, the carrier assembly being movable by a clockwork mechanism actuator. In the preferred embodiment, three such clockwork mechanisms, movements or timer units, indicated generally by the reference character 15, are provided, each having an actuator for engaging an abutment surface of the carrier assembly 12 as later described. While it will be appreciated that only one of such clockwork mechanisms or timer units 15 is required, it is customary to provide more than one unit, usually two or three such units, to provide appropriate backup or redundancy in the event one of the timer units fails. When the actuator of one or more of the timer units 15 times down to zero time, it engages the carrier assembly and moves it to a release position causing the push lever 13 and blocking mechanism 14 to free a snubber bar 16 to retract to unlocking position. The snubber bar 16 is usually installed on the door or wall of a safe or vault and is connected to the customary control bar coordinating locking and unlocking movement of the door bolts into and withdrawal from sockets in the companion wall or door jamb portion. The snubber 16 includes an inner end portion which extends into a transverse horizontal cylindrical bore 17 in the time lock casing 11. In the locked position of the time lock, a blocking member 18 occupies the position shown in FIGS. 2 and 3 blocking the midportion of the cylindrical bore 17 so that the snubber bar 16 is blocked in its outwardly projecting or locking position. When the blocking member 18 is retracted downwardly, or moved downwardly under force of gravity, upon movement of the push lever 13 to the release or outward position, either manually, as for emergency release, or mechanically by transverse movement of the carrier when one of the timers times out to zero, the snubber bar 16 may be retracted or withdrawn to extend into the portion of the bore previously occupied by the blocking member and thus retract the control bar and door bolts connected to its outer end from the keeper sockets to permit opening of the safe or vault door.

In one satisfactory example, the housing or case 11 may be a two-piece housing formed of a main or rear housing portion **11*a* and a front cover portion 11*b*, with the main or rear housing portion 11*a* cast as a one-piece structure having a rear wall 20, top and bottom walls 21 and 22, and side walls 23,24. Axially aligned apertures 23*a*,24*a* are formed in the side walls 23,24 adjacent the top wall 21 aligned with the snubber bar receiving bore portion 17, defined by partition formations within the housing to provide an unblocked path between the apertures 23*a*,24*a* for receiving the locking bolt or snubber bar 16** for movement between projected or locking position and retracted or unlocking position. The locking bolt or snubber bar, as previously stated, is normally provided on the vault or safe door on which the time lock is installed.

The front cover portion **11*b* of the housing conventionally includes an elongated cutout window portion 26 through which the dials of the clockwork mechanisms or timer units 15 may be viewed, and a plurality of key receiving openings 27 are located in the front cover below the level of the window and aligned with appropriate parts of the three timer units to manually windup or set the timer units. Also, the front cover portion of the casing may be provided below the level of the keyholes 27 with a forwardly opening recess cavity 28 for access to the manual push lever 13 forming part of the blocking mechanism to permit one to manually effect emergency release to allow the lock to be opened should one be accidentally locked inside the vault or safe. For example, this push lever 13 and its association with the blocking member 18 may be of the general type disclosed in earlier U.S. Pat. No. 4,062,210 owned by the assignee of the present invention, wherein the push lever, here indicated by the reference character 13, is in the form of an elongated lever extending through a slot in the carrier assembly 12 and includes an abutment shoulder 13*a* engaging a bounding portion, for example an angled corner, of an oversized slot 29 in the carrier assembly 12 through which the midportion of the push lever 13 extends, with the push lever biased downwardly by a spring 30 to the position shown in FIG. 3. The inner or rearmost end portion of the push lever 13 may be coupled or coact in a suitable way to a pivoted lever 31 or similar member having a portion underlying and bearing against a mechanism extending downwardly from the blocking member 18, such as the head 32*a* of the slide pin 32 spring biased downwardly by a spring 33 from the blocking member 18. It will be appreciated that when the pivoted lever 31 is in the raised position shown in FIG. 3, the contact portion of the pivoted lever bearing against the head 32*a* of the slide pin 32 lifts the head to a position causing the blocking member 18 to be in raised blocking position within the bore 17** for the snubber bar, assuming the snubber bar has been shifted outwardly to projected or locking position, thus blocking the snubber bar against inward movement to unlocking position. When the push lever 13 is manually swung upwardly to disengage the abutment shoulder 13*a* thereof from the abutment surface portion of the slot 29, or when the carrier assembly 12 is moved toward release position as later described by the timer unit, the pivoted lever 31 will be allowed to swing downwardly to a position lowering the upper portion of the blocking member 18 from the snubber bar bore 17 and thus permit retraction of the snubber bar 16 to the unlocking position. An antitampering wire 34 having its upper end fixed in the blocking member 18 may be provided rearwardly of the pin 32 as shown, extending downwardly through a slot in the head 32*a* to engage the lever 31 when the latter is in the raised position and hold the blocking member 18 in its raised blocking position.

The carrier assembly 12 may also be of the construction disclosed in said earlier U.S. Pat. No. 4,062,210, to provide a carrier plate portion 35 having upwardly extending hooked arm extensions 36 for each of the three timer or clock units, each arm 36 terminating in a vertical abutment surface 37 adapted to be engaged by the actuator of one or more of the timer or clock units 15. In the typical prior art time locks, this actuator member was in the form of a rigid pin projecting forwardly from the dials of each of the timer or clock units adapted to abut against the end abutment surface 37 of one of the extension arms 36 of the carrier plate and move the carrier plate 35 laterally, toward the right as viewed in FIG. 2, for a sufficient distance to disengage the abutment portion of the slot 29 from the lever abutment shoulder 13*a* and free the push lever 13 for forward or outward movement permitting lowering of the head portion 32*a* of the slide 32 sufficient to drop the blocking member 18 downwardly out of blocking relation with the snubber bar bore 17.

Figure 4:
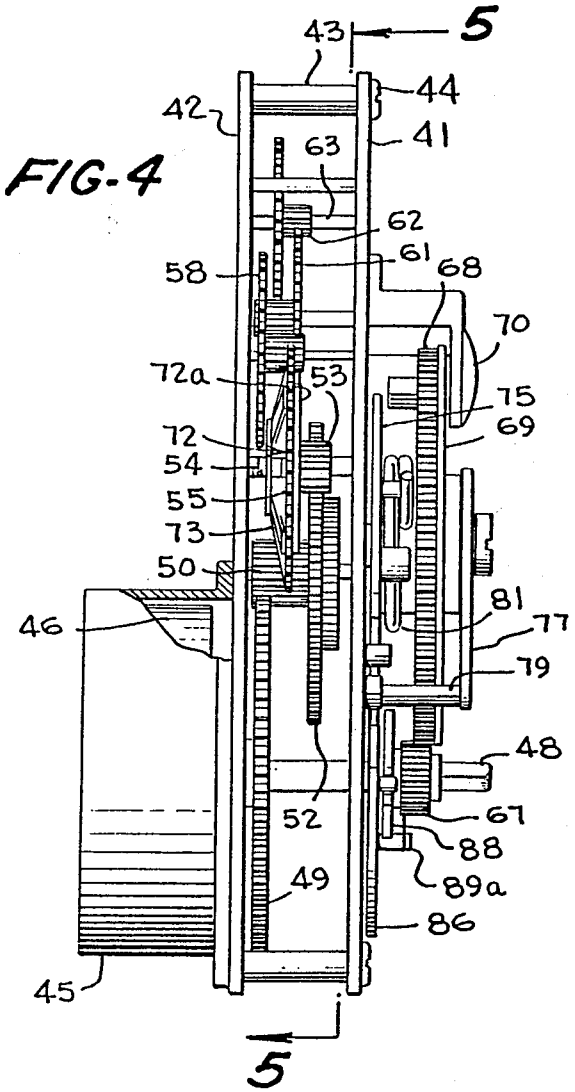
FIG. 4 is a fragmentary side elevation view, to enlarged scale, of the clockwork gearing train and clutch mechanism portions of the timer unit located between the front and rear frame panels, shown to enlarged scale.

The timer or clockwork mechanism 15 includes a clock gear train and escapement mechanism, generally indicated at 40, and supporting frame therefore of generally conventional construction, comprising a conventional frame formed of a pair of spaced rectangular plates, indicated as front plate 41 and back plate 42, separated and fixed in essentially parallel spaced relation to each other by spacer posts 43 and screws 44. Projecting rearwardly from the back plate 42 is a spring housing or barrel 45 containing the main coil spring 46 which is wound by a key 47, inserted through the key receiving opening 27 for the associated timer unit, having a non-round socket which interfits over a non-round main stem 48 on which the main spring 46 is mounted to windup and store energy in the main spring to provide the operating energy for the clock mechanism. The clock gear train 40 includes a clockwork mechanism or drive spring main gear 49, sometimes referred to in the clockwork art as the first wheel, coupled by the interengaging gear teeth on the successive gears through a gear train including small pinion 50 fixed on shaft 51 having a ratchet and pawl mechanism 64,65 and a large gear or second wheel 52 rotatable on shaft 51. Gear 52 is coupled to small pinion 53 on shaft 54 having a clutch mechanism, later described, associated with large gear or third wheel 55. The teeth of third wheel or gear 55 engage small pinion 56 on shaft 57 having large gear or fourth wheel 58 thereon which is meshed with small pinion 59 on shaft 60 having larger gear 61 thereon, in the illustrated embodiment, meshed with the small pinion 62 on the escapement wheel shaft 63. The escapement wheel or mechanism also includes a balance wheel in accordance with conventional practice. Thus the main spring 46 drives the mains spring gear 49 which through the above described gear train and ratchet and pawl mechanism 64,65 drives the shafts 51, 54, 57, 60 and escapement wheel shaft 63 in a way such that the main spring slowly unwinds at a rate accurately controlled by the escapement mechanism in a manner well understood in the clockmaker art. As illustrated in FIGS. 4 and 5, one of the gears or wheels of the gear train 40, for example, the second gear or wheel 52 is journaled for rotation on shaft 51 and ratchet wheel 64 is fixed on the shaft 51 to be engaged by the tooth of a pawl 65 pivoted on the gear 52 so that the second gear 52 rotates only in a wind-down or counterclockwise direction as viewed in FIG. 5 to transfer energy stored in the main spring through the clock gear train to the escapement mechanism.

The main stem 48 on which the main gear 49 for the clock gear train is fixed also has a smaller dial driving gear 67 thereon whose teeth interfit the teeth of dial gear 68 having the dial 69 fixed against the front face of gear 68 to move therewith, causing the dial 69 to be rotated in correlated relation with the main stem 48 and clock gear train main gear 49 as the stem 48 is wound up to set the desired time delay or time lapse before the snubber bar blocking member is released to unlock the time lock. The dial 69 carries the usual indicia indicating the number of hours the clock is to run before activating the carrier assembly to unlock the time lock, and the usual magnifier 70 and index mark or pointer 71 are associated with the time indicating dial 69 for easily reading the time on the dial face.

If the clock gear train 40 were made in the normal manner with the ratchet wheel 64 fixed on shaft 51 and the pawl 65 engaging the ratchet wheel 64 in a manner to rotate second gear 52 only in a counterclockwise direction as viewed in FIG. 5, rotation of the key 47 and main stem 48 is possible only in a wind-up direction causing the dial 69 to indicate increasing or progressively greater time delay at the index marker 71, accidental setting of the timer umit to a time delay greater than the desired number of hours could not be corrected by manual adjustment of the key and main stem which could only be rotated in the wind-up or increasing time lapse direction. However, the timer unit of the present invention has provision for such correction adjustment of the main stem and dial setting when the dial is incorrectly overdriven to an excessive time setting, by providing a clutch mechanism 72 associated with the third gear 55, formed of a clutch disc 72*a* fixed on the shaft 54 along with pinion 53, and a spring disc or spider member 73 on the shaft 54 bearing against the third gear 55 which is journaled on shaft 54 and urging the gear 55 resiliently against the clutch disc 72*a*. With such a clutch mechanism incorporated in the clock gear train, oversetting of the dial to a higher than intended time delay can be corrected simply by manually rotating the key 47 and main stem 48 in the wind-down direction until the correct time delay is indicated at the index marker. Such wind-down or reverse direction rotation of the key and main stem rotates the main gear 49, pinion 50 and its shaft 51, gear 52 (since it is being driven in the wind-down or timing out direction by ratchet wheel 64 on shaft 51 and pawl 65), pinion 53 and its shaft 54 and clutch disc 72 fixed thereon, while gear 55 and the remaining gears in the clock gear train remain stationary or regulated by the escapement mechanism. The dial gear 68 and dial 69 carried thereon are also driven in a decreasing time direction during such reverse rotation of the main stem 47, since dial gear 68 is directly coupled to gear 67 on the main stem.

The mechanism for effecting the snap action kicking or tripping of the carrier to the release or unlocked position when the clockwork gearing and dial time down to zero time position is mounted on and extends forwardly from the front frame plate 41, and is best shown in FIGS. 6 to 10. Referring to FIGS. 6 to 10, there is provided between the dial gear 68 and dial 69 and the front frame plate 41 an arcuately movable or angularly movable carrier plate 75 having a central opening through which is received the mounting post 76 extending forwardly from the front frame plate 41 to provide a post assembly on which are rotatably supported both the carrier plate 75 and the dial gear 68 and dial 69. A snap action kicker arm or carrier actuator 77 is also mounted for rotatable arcuate or angular movement on the post assembly 76 by a sleeve 76' held in place on the front frame plate by mounting screw 78. The inner end of the kicker arm or actuator 77 and the center of the plate 75 are riveted or screwed to the sleeve 76'. Movement of the kicker arm 77 and carrier plate 75 is also coordinated by a connecting post 79 fixed to an outer end portion of the kicker arm 77 and fixed to a projection **75*a*** on the carrier plate.

The carrier plate 75 has another projection **75*b* extending from the periphery thereof at a location spaced a short distance circumferentially from the first projection 75*a*, defining a gate or notch 75*c* between projections 75*a* and 75*b* which receive a stop pin or stub shaft 80 projecting forwardly from the front frame plate 41 to define a first cocked or armed position for the interconnected carrier plate 75 and kicker arm 77 and a second release or trip position therefor. The carrier plate also has a torsion trip spring 81 associated therewith, coiled around the mounting post 76 and having a pair of radially outwardly extending end formations 81*a* and 81*b*. The end formation 81*a* abuts a stop pin 82 projecting forwardly from the carrier plate 75 and the opposite radial end formation 81*b* of the torsion trip spring is engaged by the stop pin 83 projecting forwardly from the carrier plate 75 when the dial gear 68 and dial 69 occupy hour indicating positions longer than a predetermined spring arming time period, such as several hours, above the zero time position. The torsion trip spring 81 is simply captured in stressed condition between the stop pins 82 and 83 but does not contact the pin 84 of the dial gear 68 and thus cannot exert any biasing force on the carrier plate, relative to the dial gear, in this condition. However, the trip spring end portion 81*a* is engaged by the dial gear pin 84 projecting rearwardly from the dial gear 68 as the dial 69 and dial gear 68 time down toward zero position when the cocking pin 84 passes the stop pin 83 moving in a counterclockwise direction, as viewed in FIGS. 7–9, at the spring arming time, to further stress the torsion trip spring 81 and cause it to exert resilient biasing force on the carrier plate 75 relative to the dial gear 68, urging the carrier plate 75 to move in a counterclockwise direction due to the force of the spring end portion 81*a* on the carrier plate pin 82**.

Figure 8:
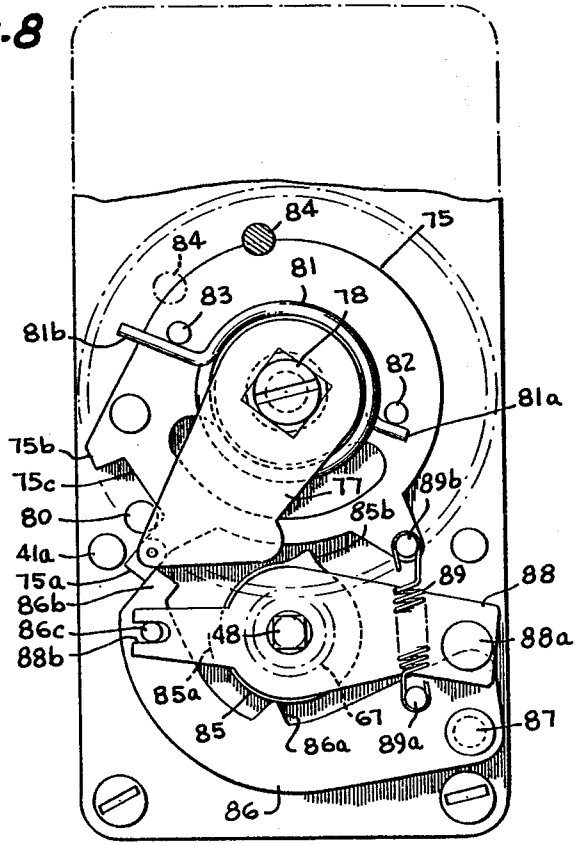
FIG. 8 is a view similar to FIG. 6, with the dial and dial gear shown in broken lines, with the timer in set condition beyond the trip spring arming position.
Figure 6:
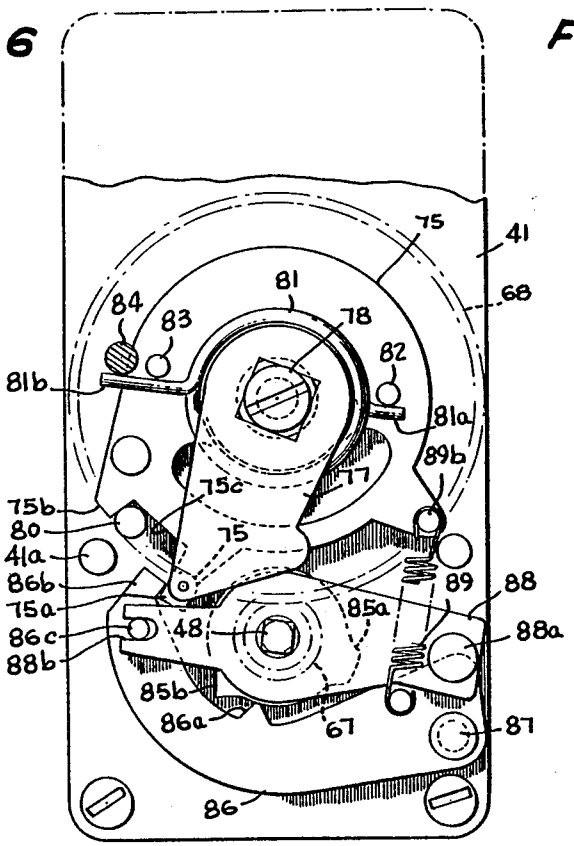
FIG. 6 is a front elevation view of the timer or clockwork unit with the magnifier and dial removed shown in the unwound condition.
Figure 7:
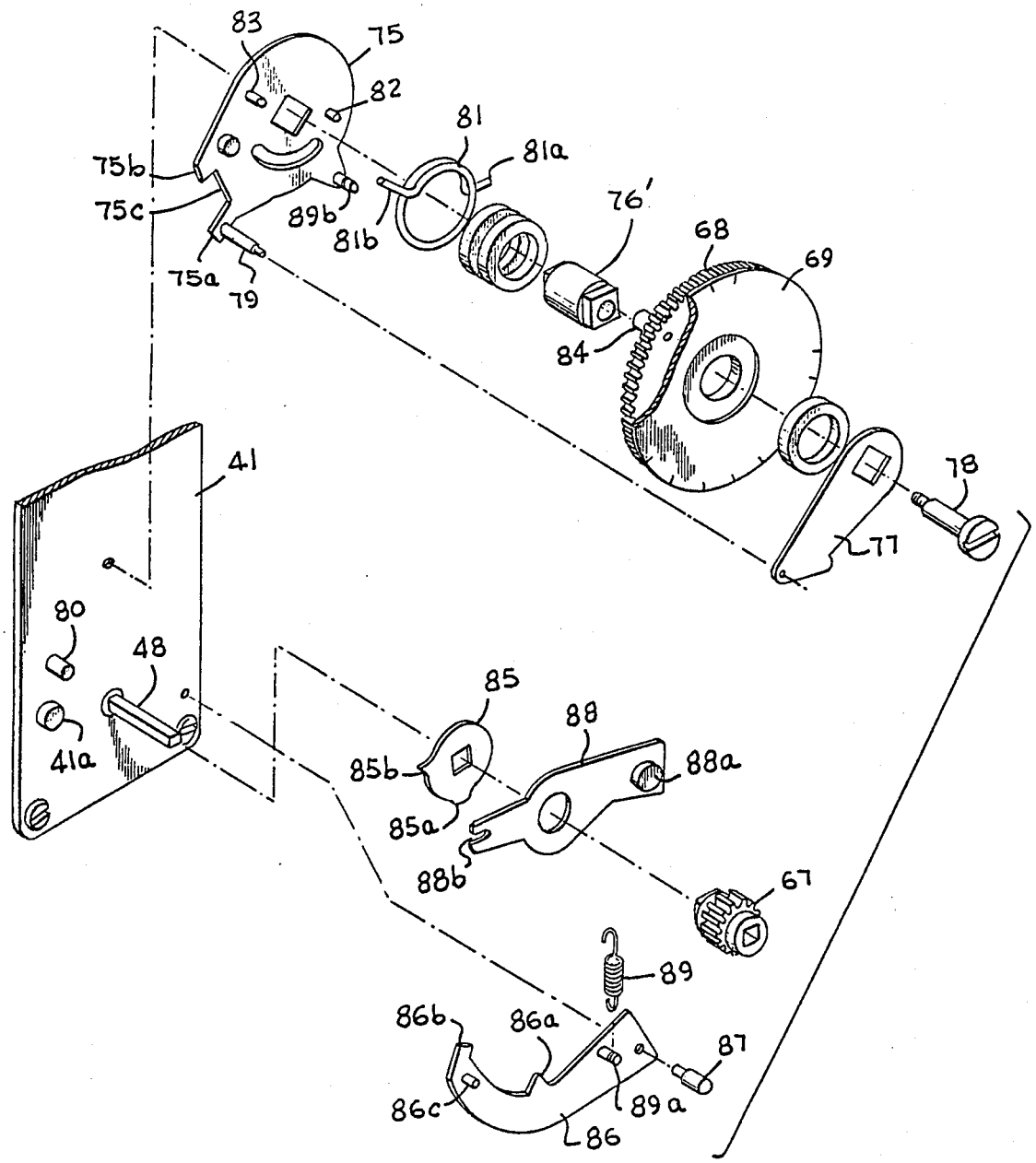
FIG. 7 is an exploded perspective view of the lever, cam, and snap-action trip arm carrier associated with the dial portion, for regulating the position of the trip arm.
Figure 9:
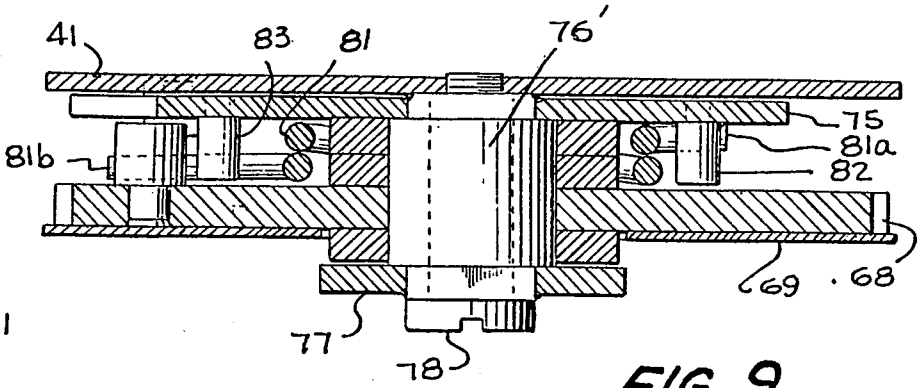
FIG. 9 is a fragmentary section view taken along the line 9—9 of FIG. 10.
Figure 10:
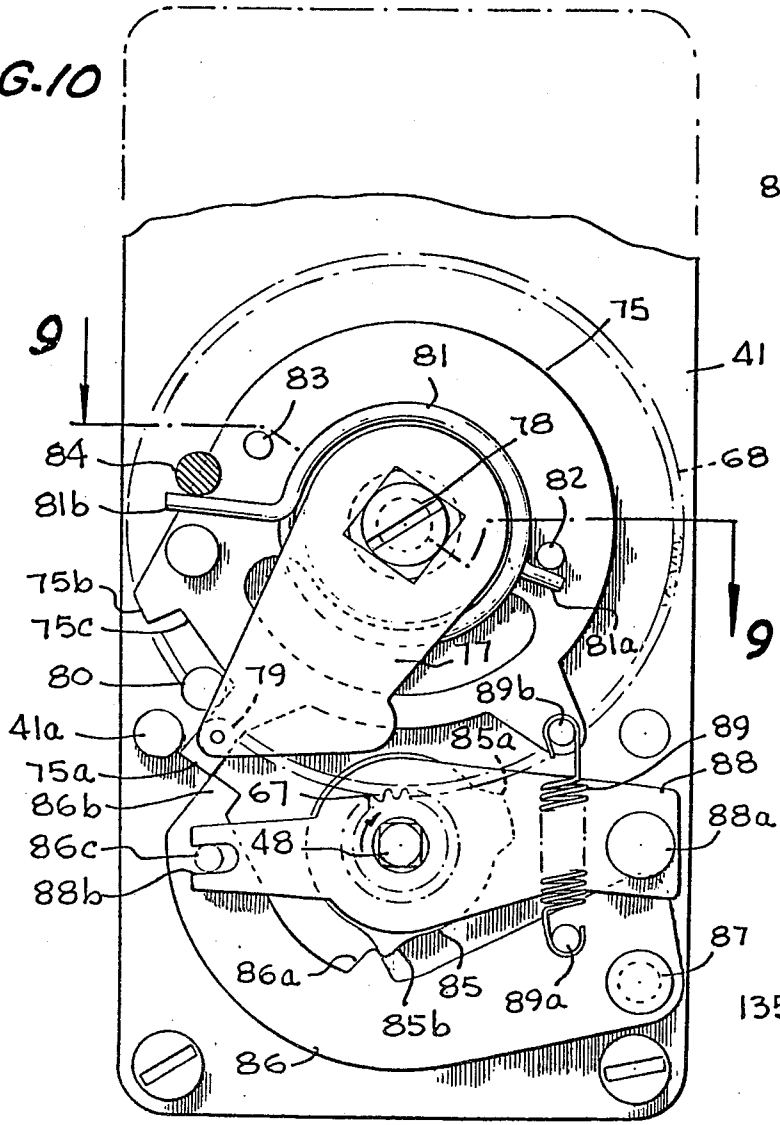
FIG. 10 is a fragmentary front elevation view of the portions of the time unit forward of the front frame plate, immediately prior to release of the kicker arm.

The positions occupied by the carrier plate 75 are regulated by a lever and cam mechanism shown to the left of the carrier plate 75 in FIGS. 8 to 10. This mechanism comprises a control cam 85 having a non-round opening receiving the main stem 48 therethrough to rotate in coordinated relation with the main stem 48 and drive spring main gear 49. A latch lever 86 is pivotally mounted on pivot post 87 to the front frame plate 41 and has a cam follower nose formation **86*a* and its midportion projecting toward the periphery of the control cam 85 to be engaged by the projections 85*a* and 85*b* on the cam periphery as the cam rotates with the drive spring main gear 49 and stem 48 during timing down of the clockwork mechanism or movement. The end portion of the latch lever 86 opposite the pivot post 87 is provided with a latch nose formation 86*b* disposed adjacent the projection 75*a* on the carrier plate and biased when the cam follower nose 86*a* rides on the non-projecting portion of the periphery of cam 85 to project slightly toward the center axis of the carrier plate 75 beyond the path of the outermost end portion of the carrier plate projection 75*a* to restrain the carrier plate 75 in either the cocked position or the release position. Associated with the latch lever 86 is an acceleration force compensating lever 88 journaled for rocking movement on a mounting post or sleeve surrounding the main stem 48, having a mass 88*a* on the lower end portion thereof as viewed in FIGS. 8 to 10, and having a slot or fork formation 88*b* at the opposite end portion of the lever 88 slidably receiving the pin 86*c* projecting forwardly from the upper end portion of the latch lever 86. This lever 88 forms together with lever 86 a dynamic system which almost completely cancels forces due to lateral accelerations. Without lever 88, lever 86 could unlatch under a shock applied to the time lock case but lever 88 counteracts this effect, so that the latch 86 stays engaged even when high accelerations are applied to the system. A coil spring 89 is also connected between anchor pins 89*a* and 89*b* on the latch lever 86 and carrier plate 75, respectively, biasing the latch lever 86 and carrier plate 75, toward each other. This coil spring 89 normally biases the carrier plate 75 in a clockwise direction, as viewed in FIGS. 8–10, with a small spring force sufficient to hold the carrier plate 75 in the cocked position shown in FIG. 8 so long as the dial gear pin 84 is spaced in a clockwise direction (or to the right as viewed in FIG. 8) from the carrier plate pin 83 and thus the pin 84 is not cocking or arming the trip spring 81 since it does not engage the spring end portion 81*b*. In this condition, the coil spring 88 exerts adequate force on the carrier plate 75 to retain it in cocked position, shown in FIG. 8, with the projection 75*a* abutting the front plate stop pin 41*a* whenever the control cam projections 85*a* or 85*b* cam the latch lever 86 to release position each cycle of rotation of the control cam 85 during timing down, until the last ¾ cycle of rotation of control cam 85 after projection 85*a* leaves the latch lever nose 86*a* and the dial gear pin 84 begins to disengage the trip spring 81 from pin 83. As long as pin 84 is to the right (clockwise) of the spring extension 81*b*, the spring is merely held in place by pins 82 and 83 which are both on the plate 75. Therefore, the spring cannot exert any force at all on any other element through it is almost fully stressed. Under this condition the small biasing spring 89 is sufficiently strong to actively pull the plate 75 to its clockwise end position and holding it there even under the influence of vibration and shock. At the same time, spring 89 pulls the latch 86 towards plate 75 blocking it securely. Spring 89 would not be of sufficient force to hold the latch 86 in engagement whilst supplying a sufficient and well-directed acceleration to the mechanism, were it not for the acceleration-force-compensating-lever 88. As the mechanism times down pin 84 approaches spring end 81*b*** and at approximately 0.8 hours before zero time touches spring end 81*b*, whereupon it slowly lifts 81*b* off pin 83 as pin 84 advances counterclockwise. Plate 75 still receives the full impact of the spring end 81*a* against pin 82 which is no longer compensated by the identical force of spring end 81*b* against pin 83. Thus, the torque applied to plate 75 increases very quickly from a negative small value supplied by spring 89 to a very high positive value supplied by spring 81, as soon as pin 84 lifts 81*b* off pin 83; if only by a very small amount. The stressing of spring 81 does not greatly increase above its original value during the whole additional bending imposed on it by pin 84 from its position drawn on FIG. 8 until its final position just before the mechanism triggers. When the mechanism is triggered by the cam projection, the carrier plate 75 and the kicker arm or actuator 77 connected therewith are kicked by spring 81 through the range of angular movement defined by gate 75*c* to the trip position. During this movement of the carrier plate 75 and kicker arm 77, the kicker arm 77 hits the abutment end 37 of the time lock carrier 36, rapidly shifting the carrier 36 to its release position relative to the control lever 13, and permitting the control lever 13 to shift forwardly to swing pivoted lever 31 downwardly and allow the blocking member 18 to drop out of snubber bar blocking position.

To review the overall operation of the time lock, each of the timer units 15 are set to the appropriate time lapse, or opening time for the next working day, by insertion of the key 47 into the appropriate key receiving openings 27 in the front wall of the lock case 11, to interfit the socket in the key on the main stem 48 of the appropriate timer unit. The key 47 is then rotated in a winding or setting direction, which is a counterclockwise direction as viewed in FIG. 5, to rotate the main stem 48 so as to wind-up or store energy in the main spring 46 and concurrently rotate the main gear 49 and the dial driving gear 67, both of which are fixed on the shaft 48, in a counterclockwise direction. The rotation of the dial driving gear 67 which is meshed with the dial gear 68 fixed to the dial 69 causes the dial 69 to be rotated in a clockwise direction as viewed in FIG. 8, progressively bringing indicia indicating higher number of hours into alignment with the index mark 71 back of the magnifier 70. Such winding direction rotation of the key 47 and main stem 48 and main gear 49 rotates the small pinion 50 and its associated shaft 51 and ratchet wheel 64 in a clockwise direction, as viewed in FIG. 5, causing the ratchet 65 on the gear 52 to be camed out of the notches by the inclined surfaces of the notches on the ratchet 64 without producing rotation of the gear 52 in a corresponding direction to the pinion 50. The remaining pinions and gears of the gear train, formed by gears 53, 55, 56, 58, 59, 61 and 62 are not driven during this winding direction movement of the main gear 49 because they are held by the escapement mechanism.

If the operator during setting of any one of the three timer units 15 (or less timer units if less than three are provided) inadvertently oversets or overdrives the key and main stem 48 to cause the dial gear 68 and dial 69 to move to a position bringing a higher number in alignment with the index mark 71 then was intended, the operator can simply move the key 47 in the reverse direction, and such reverse direction movement, which is clockwise movement as viewed in FIG. 5, of the main gear 49 and the dial driving gear 67 is allowed by the mechanism of the present invention because the clutch mechanism 72 associated with the pinion 53 and gear 55 permits the pinion 53 and its shaft 54 to rotate under the influence of the gear 52, which is driven in a counterclockwise direction with the shaft 50 and pinion 51 because of the engagement of the pawl 65 with a radial shoulder of the ratchet teeth, while the remaining gears 55, 56, 58, 60, 61 and 62 continue to be held against movement by the escapement mechanism.

When each of the timer units 15 have been set to the proper time for opening of the lock the next working day, the key 47 is withdrawn, and the blocking member 18 of the time lock continues to occupy the down or release position so long as the snubber bar 16 is in its retracted or released position in the cylinder bore 17 overlying the blocking member 18. This is true even though the operator may have positioned the lever 13 in the rearward or locking position wherein its shoulder 13*a* engages the abutment portion, such as the angled corner of opening 29, of the carrier plate 35. During this period of time, the timer units 15 continue to time-down from their set position toward the zero or trip time.

Exactly the reverse as explained above occurs when the movement is wound up again after having triggered at zero time. Pin 84 moves clockwise followed by spring end 81*b* until 81*b* abuts again on pin 83. Before this happens, spring 89 is largely overcompensated by spring 81 holding plate 75 against its counterclockwise stop. As soon as pin 84 leaves spring end 81*b*, the spring 89 is again the only active part exerting its torque on plate 75 in a clockwise direction. Therefore as soon as latch 86 frees plate 75 and if pin 84 has already left spring end 81*b*, spring 89 pulls plate 75 against its clockwise stop whereupon latch 86 blocks plate 75 in this position as drawn in FIG. 8. In this condition, the successive engagement of the control cam projections 85*a* and 85*b* with the latching lever nose 86*a* retracting the latching lever 86 to nonlatching position twice each revolution of the main stem 48 does not produce any movement of the carrier plate 75 from its latched position, as it remains biased to that position by the coil spring 89.

When the timer units time-down to a time sufficiently close to zero or tripping time for the dial gear spring cocking pin 84 to move counterclockwise past the carrier plate stop pin 83 into engagement with the end portion 81*b* of the trip spring 81, further movement of the dial gear 68 toward zero time progressively increases the spring tension force of the trip spring 81, and upon the next engagement of a control cam projection with the latch lever nose 86*a*, which is the cam projection 85*b*, to retract the latch lever end formation 86*b* from latching position holding the carrier plate projection 75*a*, the carrier plate is now rotated rapidly by the force stored in the spring 81 from the latched position to the release position over the range permitted by the stop pin 80 in the notch 75*c*, thus causing consequent rapid rotation of the kicker arm or carrier actuator 77 to hit the abutment end surface 37 of the carrier plate arms 36 (or whichever carrier arm 36 is first hit by the kicker arm 77 if all timers do not trip simultaneously) to effect rapid kicking of the carrier plate 35 to the release position. Because of the spring forced kicking action of the kicker arm 77 at the zero release time precisely determined by the engagement of the control cam projection 85*b* with the follower nose 86*a* of the latch lever 86, extremely accurate action to move the time lock carrier plate 35 to release position at the correct time is achieved, avoiding the variations which have been found to occur in release time with time locks wherein the carrier is shifted to release position by the conventional provision of a rigid pin projecting from the face of the dial.

Figure 11:
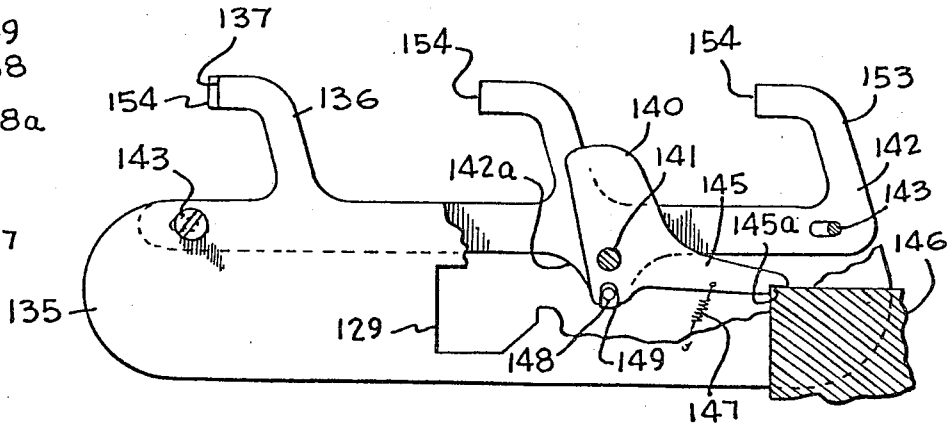
FIG. 11 is a fragmentary front elevation view of a modified carrier assembly with a deadbolt latch lever and release actuator therefor, viewed from a section plane immediately forwardly of the carrier.

Referring to FIG. 11, there is illustrated in fragmentary front elevation from a section plane immediately forwardly of the carrier assembly, a modified carrier assembly useable in the time lock of the present invention, having a deadbolt latch lever and release actuator therefor to releasibly latch the carrier plate, here indicated by reference character 135, against accidental or vibrational lateral movement to the release position.

In the embodiment shown in FIG. 11, the carrier plate 135 has the usual upwardly curving or hook-shaped extension arms 136 terminating in abutment end surfaces 137 to be engaged by the kicker arms or carrier actuators 77 of the timer units of the time lock, and having the same slot 129 with an angled corner or similar abutment portion to coact with the abutment shoulder 13*a* of the push lever 13 in the same manner as the slot 29 of the carrier 35 of the previously described embodiment to releasibly hold the push lever 13 in the locking position and to release it to allow movement of the blocking member 18 to the snubber bar releasing position when the timer units time down to zero time. In the embodiment illustrated in FIG. 11, a deadbolt latch lever 140 is pivotally supported on and immediately rearwardly of the carrier plate 135 between the carrier plate 135 and a deadbolt latch lever plate 142 also mounted on the carrier plate 135 by mounting screws 143 extending through slots in the plate 142 allowing a limited amount of lateral movement of the plate 142 relative to the carrier plate 135. The deadbolt latch lever 140 has a latch arm 145 extending therefrom terminating in a notch 145*a*, for example a right angle notch or V-notch in the outer end portion thereof to engage a corner of a right anugular shoulder formation indicated at 146 of the time lock case, for example in the lower right hand corner portion thereof viewed with reference to FIG. 2. The latch arm portion 145 is normally resiliently biased downwardly or in a clockwise direction about the pivot pin 141 by spring 147, and has an eccentric actuating pin 148 projecting rearwardly from a portion of the deadbolt latch lever 140 below and near the pivot pin 141 into a slot 149 in a downwardly extending portion 142*a* of the actuator plate 142. The actuator plate 142 also includes integral upwardly curving arms 153 generally duplicating the shape of the carrier plate extension arms 136 and terminating in abutment surfaces 154 which normally project slightly to the left of or in advance of the abutment surfaces 137 of the carrier plate extension arms 136 so that the abutment end portions 154 of the actuator plate 142 will be engaged by the kicker arm 77 of the timer units slightly before the kicker arm engages the abutment surfaces 137 of the carrier plate 135. It will be apparent, therefore, that when the kicker arm 77 of one or more of the timer units is engaged and shifted to the right, as viewed in FIG. 11, immediately before engagement of the trip arm 77 with the abutment surface 137 of the carrier plate 135, the actuator plate 142 is swung to the right, effecting a slight upward or counterclockwise movement of the lever 140 because of movement of the slot 149, and consequent movement of the pin 148, to the right with the actuator plate 142, disengaging the notch 145*a* of the deadbolt latch lever 140 from the stop shoulder formation 146 and thereby freeing the carrier plate 135 to be moved to the right when the kicker arm 77 of one or more timer units engages the carrier plate stop surface or surfaces 137 to effect releasing movement of the carrier plate 135.

I claim:

1. A time lock for bank vault doors and the like, comprising a housing, a plurality of timer units of the settable dial type mounted in said housing, a carrier assembly movably mounted in the housing for movement between a first locking position and a second release position, snubber bar blocking means in said housing movable between a snubber bar blocking position and a release position and control means therefor releasibly held by the carrier assembly for holding the blocking means in blocking position while said carrier assembly occupies said locking position, each of said timer units having a rotatable time indicating dial and a clockwork mechanism intercoupled therewith including manual setting means for rotating the dial to the desired time lapse indication, snap action carrier trip means including a spring driven kicker arm supported for movement forwardly adjacent the face of the dial through a trip stroke between a cocked position and a disarmed position, latch means for releasably latching said kicker arm in the cocked position when said dial occupies time indicating positions above zero time, and release means driven by the clockwork mechanism for activating the latch means to release the kicker arm in spring forced condition from said cocked position when the dial reaches zero time to cause the kicker arm to be abruptly kicked by the spring force thereon against said carrier assembly for abruptly shifting the carrier assembly to release position.

2. A time lock as defined in claim 1, wherein said carrier assembly includes a vertical carrier plate having an abutment surface to be engaged by the kicker arm to move the carrier plate to release position, a deadbolt latch lever pivotally mounted on the carrier plate and resiliently biased in a direction to releasably engage a stop surface portion of the lock housing for holding the carrier plate against movement from said first locking position toward said release position when the carrier assembly is in said locking position, an actuator plate member supported for limited relative movement with respect to the carrier plate having an abutment shoulder thereon projecting a short predetermined distance ahead of said abutment surface to be engaged by the kicker arm immediately prior to engagement of the kicker arm with said abutment surface when the kicker arm is released from the cocked position to effect predetermined limited travel of the actuator plate relative to the carrier plate, and said actuator plate having means for moving the deadbolt latch lever out of engagement with said stop surface portion upon movement of the actuator plate by the kicker arm.

3. A time lock as defined in claim 1, wherein said latch means includes a rotatable control plate linked to the kicker arm and having abutment surfaces thereon defining said cocked and disarmed positions, a torsion spring coactive with the control plate and dial to condition the torsion spring to place the control plate and kicker arm in spring armed condition at predetermined positions of the dial above zero time, and said release means including a latch spring for holding said control plate in cocked position whenever the spring abutment member on the dial is in non-engaging relation spaced from the torsion spring notwithstanding displacement of the latch means to release position by said cam periodically during timing down of the clockwork mechanism, and means for maintaining said torsion spring in stressed condition during such non-engagement of the dial spring abutment member therewith in order that said torsion spring exerts its full force onto the control plate as soon as the dial spring abutment member touches the torsion spring.

4. A time lock as defined in claim 1, wherein said release means includes a rotatable cam driven by the clockwork mechanism during timing down and said latch means includes a lever system under control of said cam to effect an instantaneous activation of the latch means to release position relative to the kicker arm at the instant the clockwork mechanism times down to zero time on the dial.

5. A time lock as defined in claim 4, wherein said latch means includes a rotatable control plate linked to the kicker arm and having abutment surfaces thereon defining said cocked and disarmed positions, a torsion spring coactive with the control plate and dial to condition the torsion spring to place the control plate and kicker arm in spring armed condition at predetermined positions of the dial above zero time, and said release means including a latch spring for holding said control plate in cocked position whenever the spring abutment member on the dial is in non-engaging relation spaced from the torsion spring notwithstanding displacement of the latch means to release position by said cam periodically during timing down of the clockwork mechanism, and means for maintaining said torsion spring in stressed condition during such non-engagement of the dial spring abutment member therewith in order that said torsion spring exerts its full force onto the control plate as soon as the dial spring abutment member touches the torsion spring.

6. A time lock as defined in claim 4, wherein said kicker arm is supported for rotation about the center axis of said dial, and the timer unit includes a main spring for arming and driving the clockwork mechanism and a key operable main stem therefor, and said latch means including a kicker arm control plate rotatable about the center axis of the dial between circumferentially spaced cocked and disarmed positions and coupled to the kicker arm, said cam being mounted on said main stem.

7. A time lock as defined in claim 6, wherein the spring drive for said kicker arm includes a torsion spring adjacent said control plate, relatively movable spring abutment members including spring abutment members on said control plate and dial for engaging portions of the torsion spring and arming the control plate and kicker arm for carrier actuation of the kicker arm when the dial is in a predetermined range of displaced time positions above zero time.

8. A time lock as defined in claim 7, wherein said release means includes a latch spring for holding said control plate in cocked position whenever the spring abutment member on the dial is in non-engaging relation spaced from the torsion spring notwithstanding displacement of the latch means to release position by said cam periodically during timing down of the clockwork mechanism, and means for maintaining said torsion spring in stressed condition during such non-engagement of the dial spring abutment member therewith in order that said torsion spring exerts its full force onto the control plate as soon as the dial spring abutment member touches the torsion spring.

9. A time lock as defined in claim 4, wherein said kicker arm is supported for rotation about the center axis of said dial, and the timer unit includes a main spring for arming and driving the clockwork mechanism and a key operable main stem therefor, and said latch means including a kicker arm control plate rotatable about the center axis of the dial between circumferentially spaced cocked and disarmed positions and coupled to the kicker arm, said cam being mounted on said main stem and said lever system including a cam follower latch lever following said cam and controlled thereby to release the kicker arm control plate from cocked position at the instant the dial reaches zero time.

10. A time lock as defined in claim 9, wherein the spring drive for said kicker arm includes a torsion spring adjacent said control plate, relatively movable spring abutment members including spring abutment members on said control plate and dial for engaging portions of the torsion spring and arming the control plate and kicker arm for carrier actuation of the kicker arm when the dial is in a predetermined range of displaced time positions above zero time.

11. A time lock as defined in claim 10, wherein said release means includes a latch spring for holding said control plate in cocked position whenever the spring abutment member on the dial is in non-engaging relation spaced from the torsion spring notwithstanding displacement of the latch lever to release position by said cam periodically during timing down of the clockwork mechanism, and means for maintaining said torsion spring in stressed condition during such non-engagement of the dial spring abutment member therewith in order that said torsion spring exerts its full force onto the control plate as soon as the dial spring abutment member touches the torsion spring.

12. A time lock as defined in claim 9, wherein said latch means includes said rotatable control plate linked to the kicker arm and having abutment surfaces thereon defining said cocked and disarmed positions, a torsion spring coactive with the control plate and dial to condition the torsion spring to place the control plate and kicker arm in spring armed condition at predetermined positions of the dial above zero time, and said release means including a latch spring for holding said control plate in cocked position whenever the spring abutment member on the dial is in non-engaging relation spaced from the torsion spring notwithstanding displacement of the latch means to release position by said cam periodically during timing down of the clockwork mechanism, and means for maintaining said torsion spring in stressed condition during such non-engagement of the dial spring abutment member therewith in order that said torsion spring exerts its full force onto the control plate as soon as the dial spring abutment member touches the torsion spring.

13. A time lock as defined in claim 1, wherein said kicker arm is supported for rotating about the center axis of said dial, and the timer unit includes a main spring for arming and driving the clockwork mechanism and a key operable main stem therefor, and said latch means including a kicker arm control plate rotatable about the center axis of the dial between circumferentially spaced cocked and disarmed positions and coupled to the kicker arm.

14. A time lock as defined in claim 13, wherein said latch means includes said rotatable control plate linked to the kicker arm and having abutment surfaces thereon defining said cocked and disarmed positions, a torsion spring coactive with the control plate and dial to condition the torsion spring to place the control plate and kicker arm in spring armed condition at predetermined positions of the dial above zero time, and said release means including a latch spring for holding said control plate in cocked position whenever the spring abutment member on the dial is in non-engaging relation spaced from the torsion spring notwithstanding displacement of the latch means to release position by said cam periodically during timing down of the clockwork mechanism, and means for maintaining said torsion spring in stressed condition during such non-engagement of the dial spring abutment member therewith in order that said torsion spring exerts its full force onto the control plate as soon as the dial spring abutment member touches the torsion spring.

15. A time lock as defined in claim 13, wherein the spring drive for said kicker arm includes a torsion spring adjacent said control plate, relatively movable spring abutment members including spring abutment members on said control plate and dial for engaging portions of the torsion spring and arming the control plate and kicker arm for carrier actuation of the kicker arm when the dial is in a predetermined range of displaced time positions above zero time.

16. A time lock as defined in claim 15, wherein said release means includes a latch spring for holding said control plate in cocked position whenever the spring abutment member on the dial is in non-engaging relation spaced from the torsion spring notwithstanding displacement of the latch means to release position by said cam periodically during timing down of the clockwork mechanism, and means for maintaining said torsion spring in stressed condition during such non-engagement of the dial spring abutment member therewith in order that said torsion spring exerts its full force onto the control plate as soon as the dial spring abutment member touches the torsion spring.

17. A timer unit of the settable dial type for a time lock to engage and shift a carrier assembly of the time lock from a locking position holding a snubber bar blocking mechanism in blocking position to a release position releasing the blocked mechanism to an unlocking position, the timer unit comprising a rotatable time lapse indicating dial, a clockwork mechanism intercoupled with the dial including a gear train and escapement mechanism and a drive spring for the gear train, manual setting means for the gear train and dial including a key operable main stem coupled to the drive spring to wind the same and coupled to the dial to adjust the dial to time lapse positions indicating a desired future unlocking time for the time lock, snap action trip means for engaging and suddenly shifting the carrier assembly to release position at zero time on the dial including a spring driven kicker arm supported for movement forwardly adjacent the face of the dial through a trip stroke between a cocked position and a disarmed position, latch means for releasably latching said kicker arm in the cocked position when said dial occupies time indicating positions above zero time, and release means driven by the clockwork mechanism for activating the latch means to release the kicker arm in spring forced condition from said cocked position when the dial reaches zero time to cause the kicker arm to be abruptly kicked by the spring force thereon against the carrier assembly for abruptly shifting the carrier assembly to release position.

18. A timer unit for a time lock as defined in claim 17, wherein said release means includes a rotatable cam driven by the clockwork mechanism during timing down and said latch means includes a lever system under control of said cam to effect an instantaneous activation of the latch means to release position relative to the kicker arm at the instant the clockwork mechanism times down to zero time on the dial.

19. A timer unit for a time lock as defined in claim 18, wherein said kicker arm is supported for rotation about the center axis of said dial, and the timer unit includes a main spring for arming and driving the clockwork mechanism and a key operable main stem therefor, and said latch means including a kicker arm control plate rotatable about the center axis of the dial between circumferentially spaced cocked and disarmed positions and coupled to the kicker arm, said cam being mounted on said main stem and said lever system including a cam follower latch lever following said cam and controlled thereby to release the kicker arm control plate from cocked position at the instant the dial reaches zero time.

20. A timer unit for a time lock as defined in claim 19, wherein the spring drive for said kicker arm includes a torsion spring adjacent said control plate, relatively movable spring abutment members including spring abutment members on said control plate and dial for engaging portions of the torsion spring and arming the control plate and kicker arm for carrier actuation of the kicker arm when the dial is in a predetermined range of displaced time positions above zero time.

21. A timer unit for a time lock as defined in claim 20, wherein said release means includes a latch spring for holding said control plate in cocked position whenever the spring abutment member on the dial is in non-engaging relation spaced from the torsion spring notwithstanding displacement of the latch means to release position by said cam periodically during timing down of the clockwork mechanism, and means for maintaining said torsion spring in stressed condition during such non-engagement of the dial spring abutment member therewith in order that said torsion spring exerts its full force onto the control plate as soon as the dial spring abutment member touches the torsion spring.

22. A timer unit for a time lock as defined in claim 17, wherein said kicker arm is supported for rotating about the center axis of said dial, and the timer unit includes a main spring for arming and driving the clockwork mechanism and a key operable main stem therefor, and said latch means including a kicker arm control plate rotatable about the center axis of the dial between circumferentially spaced cocked and disarmed positions and coupled to the kicker arm.

23. A timer unit for a time lock as defined in claim 22, wherein the spring drive for said kicker arm includes a torsion spring adjacent said control plate, relatively movable spring abutment members including spring abutment members on said control plate and dial for engaging portions of the torsion spring and arming the control plate and kicker arm for carrier actuation of the kicker arm when the dial is in a predetermined range of displaced time positions above zero time.

24. A timer unit for a time lock as defined in claim 23, wherein said release means includes a latch spring for holding said control plate in cocked position whenever the spring abutment member on the dial is in non-engaging relation spaced from the torsion spring notwithstanding displacement of the latch means to release position by said cam periodically during timing down of the clockwork mechanism, and means for maintaining said torsion spring in stressed condition during such non-engagement of the dial spring abutment member therewith in order that said torsion spring exerts its full force onto the control plate as soon as the dial spring abutment member touches the torsion spring.

* * * * *